US005464222A

United States Patent [19]

Carney

[11] Patent Number: 5,464,222

[45] Date of Patent: Nov. 7, 1995

[54] GOLF CLUB PUTTER WITH LASER AIMING SYSTEM

[76] Inventor: William P. Carney, 4 High Ridge La., Oyster Bay, N.Y. 11771

[21] Appl. No.: 290,613

[22] Filed: Aug. 15, 1994

[51] Int. Cl.[6] ..... A63B 69/36

[52] U.S. Cl. ..... 273/186.3

[58] Field of Search ..... 273/164.2, 164.1, 273/163 R, 163 A, 162 R, 194 A, 194 R, 186.3, 186.2

[56] References Cited

U.S. PATENT DOCUMENTS

| | | | |
|---|---|---|---|
| 3,953,034 | 4/1976 | Nelson | 273/186.3 |
| 5,165,691 | 11/1992 | Cook | 273/186.3 |
| 5,169,150 | 12/1992 | Tindale | 273/186.3 X |
| 5,193,812 | 3/1993 | Hendricksen | 273/186.3 |
| 5,217,228 | 6/1993 | Aguilar | 273/186.3 |
| 5,374,063 | 12/1994 | Ogden | 273/186.3 |

*Primary Examiner*—George J. Marlo
*Attorney, Agent, or Firm*—Charles E. Temko

[57] ABSTRACT

A golf club putter with a laser aiming system is disclosed. The putter includes a shaft with a hollow axial length portion a head with a golf ball striking face and a grip. The laser aiming system is built into the club and comprises a laser beam generating device which emits a laser beam through a lateral bore in the shaft. The laser beam is emitted in an essentially horizontal direction perpendicular to and above the face of the club and is emitted above a location of the face where a golf ball is positioned to be struck. The laser beam is employed by a user to ensure proper club face alignment when practicing putting.

11 Claims, 8 Drawing Sheets

GOLF CLUB PUTTER WITH LASER AIMING SYSTEM

BACKGROUND OF THE INVENTION

1. Field of the Invention

This invention relates to golf clubs and more particularly to a novel arrangement for mounting a laser aiming system in a putter.

2. Description of Related Art

Golf club laser aiming systems which provide golf club putters with laser aiming beams are well known in the art. Such systems are used by golfers as training aids when practicing putting. It is also generally accepted that a golfer achieves optimum putting practice on an actual putting green using the same putter as will be used on the course. Both private and public golf courses typically have practice greens so that a golfer may practice with his or her putter before going out to play a round of golf. Practice greens are maintained to replicate the greens on the course and thereby provide a player the opportunity to practice putting speed and putting direction under actual playing conditions.

Putting speed is partially a function of the condition of the green and partially a function of the head weight and feel of the putter. Putting direction is a function of the golfer's perception of proper club alignment, that is, how he or she aims the putter at the hole. Typically, a putter is properly aimed and aligned for a straight putt when the face of the putter is centered behind the ball and is perpendicular to the desired line or path of the ball.

On the practice green, a golfer gets a sense of the speed of the green by noting the speed of his or her actual putt. Similarly, a golfer develops a sense of proper club alignment by aiming his or her putter at a practice green pin located in the center of a practice green hole and after aiming the club and striking the ball, noting the actual direction of his or her putt.

The appearance of the club-ball relationship, the weight of the club head and the general feel of the putter are important factors which influence the development of a successful and repeatable putting stroke. Therefore, as was previously indicated, it is desirable for golfers to practice with the same putter they routinely use on the golf course. Further, because golfers are particular about the overall appearance of their clubs, it is desirable that any aiming device be completely concealed within the club. It is also desirable that the aiming device be suitable for use on a putting green without the need for constant and complicated laser beam aiming adjustments.

The following United States Patents show prior art aiming systems to which the present invention is applicable:

U.S. Pat. No. 5,029,868, which issued on Jul. 9, 1991 to Marion M. Cloud, discloses a putter laser aiming system which includes a high intensity light source located in the grip portion of a club. The light source directs a light beam down the hollow portion of the shaft through fiber optic cables which terminate in lenses mounted in the face of the putter. The disclosure delineates two lens arrangements. The first is a two lens configuration having a lens in the club face on either side of a golf ball positioned to be struck at the center of the club's face. The second is a one lens configuration having a single lens at the approximate point at which the club face impacts the ball. The patent also discloses a target with a reflective surface designed to be positioned at a distance from the user to indicate the alignment of the club face as determined by the direction of the projected light beams. It does not, however, provide a laser aiming arrangement for use on a typical practice green. The two beam configuration disclosed cannot be aimed at a single pin and the one beam configuration, intended for practicing club alignment without a ball, cannot be aimed at a pin with a ball in position to be putted because the emitter is located on the face of the club in the path of the ball.

U.S. Pat. No. 5,165,691, which issued on Nov. 24, 1992 to Jon C. Cook, discloses a golf club laser aiming system which comprises one or two laser generators mounted on the club head with the associated power source mounted in the club handle. It does not specifically address the problem of mounting a concealed laser aiming system within the club which provides a laser beam projecting from the club directly above and essentially parallel to the desired path of a struck golf ball. In addition, the two parallel light beams as disclosed cannot be conveniently used to practice club alignment on a practice green having cups fitted with individual hole marking pins.

U.S. Pat. No. 5,169,150, which issued on Dec. 8, 1992 to John C. Tindale, discloses a single laser beam generator externally attached to a club head which emits a laser beam at essentially the point on the face of the head where the ball is struck by the club face. The laser beam, as described in the disclosure, is aimed at a target having a graduated measuring scale so that the user of the club may calibrate a sighting line on the putter to compensate his or her inherently misaligned putting stroke. It does not provide a solution for mounting a laser within the club. In the arrangement disclosed, the club head cannot be aimed at a pin on a putting green with the golf ball in position to be putted because of the location of the laser emitter.

U.S. Pat. No. 5,193,812, which issued on Mar. 16, 1993 to Mark W. Hendricksen, discloses a laser aiming device which attaches to a club head by means of a fixed mounting bracket. The laser aiming device and associated bracket are located on the top of the head to provide a laser beam in a direction perpendicular to and above the club face and above the desired location on the club face for striking the ball. One of the disadvantages of this disclosure is that it adds a distracting and heavy appurtenance to the head of the club. It does not address the problem of concealing the laser generator in the club in order to avoid affecting the appearance and feel of the putter. In addition, the mounting bracket and laser module are affixed to the putter such that they not only affect the appearance and inertia of the club head but are also easily damaged when the putter is carried in a typical golf bag with other clubs.

U.S. Pat. No. 5,213,331, which issued on Mar. 25, 1993 to Frank Avanzini, discloses a laser aiming device which attaches to a club head by means of an adjustable mounting bracket. The laser unit and its associated bracket are adjustable in a vertical plane perpendicular to the putter's ball striking surface so that the laser beam may be projected over the top of a golf ball onto a putting surface at select distances forwardly of the golf ball. It does not disclose a means by which a laser aiming device can be concealed within a club thereby eliminating the need for an external mounting bracket.

U.S. Pat. No. 5,217,228, which issued on Jun. 8, 1993 to Juan De Aguilar, discloses a golf club having a head, a grip and a shaft which includes a laser generator and a reflecting mirror mounted in the shaft so as to emit a laser beam in a horizontal direction from a point in the shaft midway between the head and the grip. The laser beam is projected substantially above and offset to either the right or to the left (to the right for a right handed player and to the left for a left handed player) and parallel to the intended path of a golf ball after being struck by the club.

In a first aspect of the disclosure, the beam is projected by a fixed mirror in the direction as described above. In a second aspect, instead of being fixed to the shaft by means of a stud, the mirror is mounted on a rod which extends across the shaft thereby allowing the angle of the mirror and thus the direction of the laser beam to be adjusted in one axis. In both aspects, there are disadvantages when De Aguilar's mirror and laser arrangements are employed to aim a putter at a pin on a practice green.

The geometry of the fixed mirror configuration is such that its offset laser beam cannot be aimed at a single pin centered in a hole while maintaining the club face perpendicular to the intended path of the ball Being able to aim the laser beam at the pin while maintaining the face of the club perpendicular to the theoretically ideal line of the putt is a requirement of a properly aimed straight putt which is not met by the fixed mirror arrangement. The preceding alignment shortcoming is a disadvantage when employing De Aguilar's fixed mirror embodiment to practice putting.

The geometry of De Aguilar's adjustable mirror configuration requires a unique vertical and a unique horizontal angle setting for each putt of varying distance. The disclosure of De Aguilar does not teach a gimbal mounting arrangement capable of providing angle adjustments in two axes. The aforementioned aiming problem is a disadvantage when employing the adjustable mirror embodiment of De Aguilar to practice putting.

As can be seen from the foregoing, there is a definite need for a golf club putter with a laser aiming system which does not significantly add to the weight of the club's head and which is concealed within the club so as not to affect the club's appearance. In addition, a system is needed which does not incorporate laser beams emitted from the striking face of the club in order to avoid damage to collimating lenses mounted on the striking surface. Also, a system is needed which enables the user to aim the laser at a pin with the ball in position to be putted. In summary, a putter with a laser aiming system is required that can be conveniently used on a practice green without constant beam adjustment and then taken on the course and used in a regular game of golf.

SUMMARY OF THE INVENTION

The present invention overcomes the above described disadvantages and provides a putter having a concealed laser aiming system which may not only be used for practice but may also be used in a regular game of golf.

In one aspect, the present invention comprises a golf club putter having a shaft with a hollow axial length portion for securing a putter head at a first end of the shaft and a grip at a second end of the shaft. The head has a face on a front side thereof for striking a golf ball and an opening on a top side of the head for securing the first end of the shaft. The first end of the shaft has a laser module mounted therein adapted to project a laser beam coincident with the centerline of a lateral bore in the first end of the shaft. The first end of the shaft is secured to the top side of the head with an angular disposition such that the centerline of the lateral bore extends in an essentially horizontal direction in a vertical diametral plane of the golf ball perpendicular to the face when the ball is positioned to be struck. The laser beam is employed by a user of the club for controlling the direction of the golf ball.

In a second aspect, the present invention comprises a golf club putter having a shaft with a hollow length portion and a head having a face on a front side thereof for striking a golf ball secured at a first end of the shaft. The head includes a shaft attachment portion having an inner cavity and an opening in a top portion of the inner cavity for securing the head to the shaft. A grip for holding the golf club is secured at a second end of the shaft. A laser generator is positioned in the inner cavity and is adapted to direct a laser beam through a lateral bore in the shaft attachment portion. The laser beam is emitted perpendicular to and above the face and above an approximate location on the face where the golf ball is positioned to be putted. The laser beam is employed by a user of the club for controlling the direction of the golf ball.

DETAILED DESCRIPTION OF THE INVENTION

Figure 1:
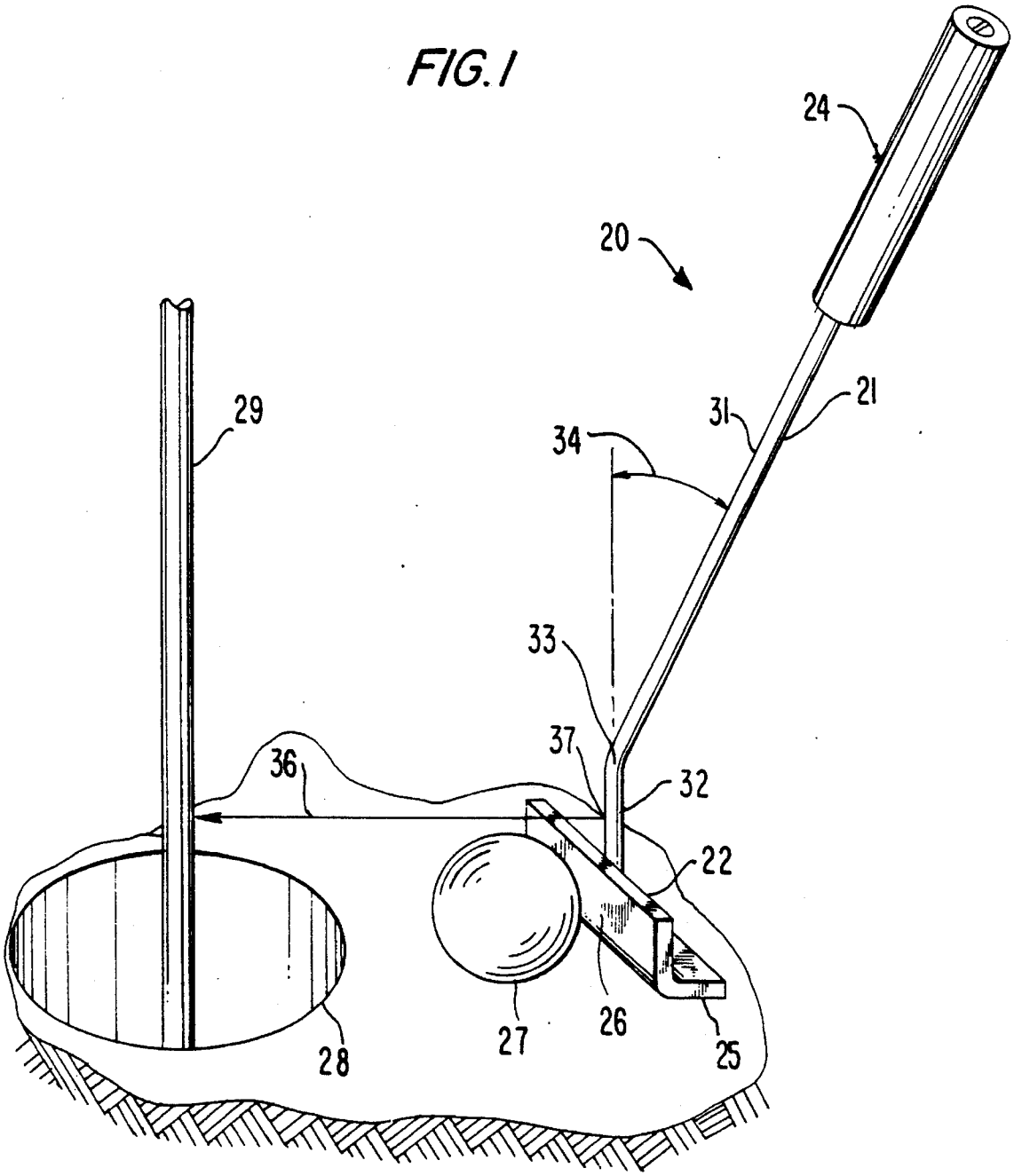
FIG. 1 is a perspective view of one embodiment of a golf club putter including the laser aiming system of the present invention.
Figure 2:
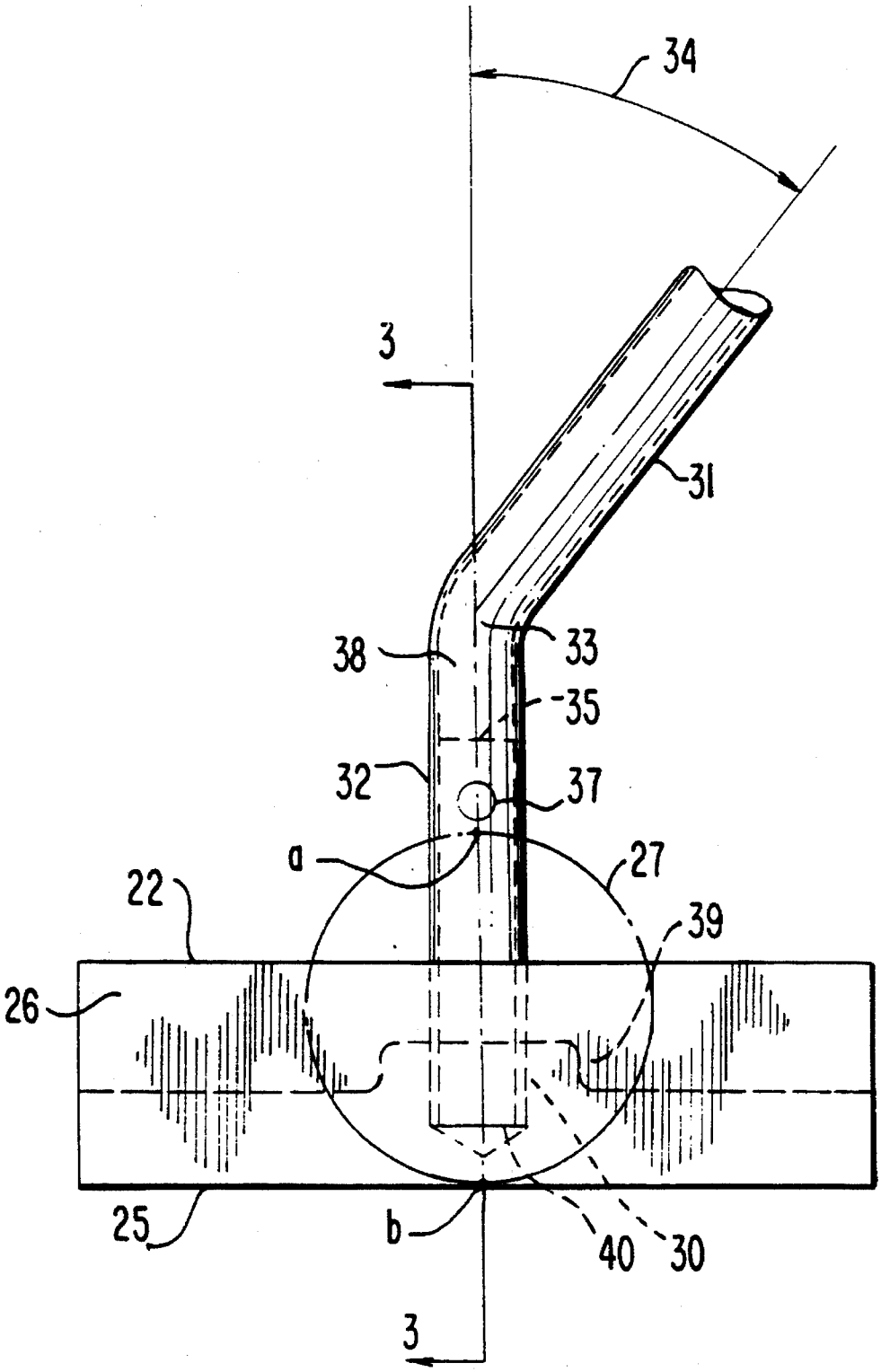
FIG. 2 is an enlarged fragmentary front elevation of the putter head shown in FIG. 1.

As illustrated in FIGS. 1 and 2, a putter, generally referred to by reference number 20, comprises a shaft 21, a head 22 and a grip 24 which is used by a player to hold and align the club 20. The head 22 has a generally flat weighted heel portion 25 and an essentially vertical ball striking face 26. Shown in front of the ball striking face 26 is a golf ball 27 positioned to be putted into a cup 28 having a cup marking pin 29, the lower portion of which is shown positioned in the cup 28.

In the putter configuration of this embodiment, the shaft 21 is affixed to the head 22 by means of a closely fitted shaft mounting hole 30 located in a raised central section 39 of the heel portion 25. The shaft 21 includes two sections, an essentially vertical section 32 which extends upwardly from the shaft mounting hole 30 to a bend point 33 and a non-vertical section 31 which extends from the bend point 33 to where the shaft 21 ends in the grip 24. The dimension of the vertical section 32, the magnitude of a bend angle 34 and the length of the non-vertical section 31 determine the position of the player's hands when he or she holds the grip 24.

A laser beam generating module, generally referred to by reference number 35, is mounted in a hollow axial core 38 of the vertical section 32 and, as will be described in more detail below is adapted to project a laser aiming beam 36 through a lateral bore 37. The laser beam 36 is projected in an essentially horizontal direction above the golf ball 27 (shown in phantom in FIG. 2) perpendicular to the striking face 26. Before stroking a practice putt, the golfer aligns the putter 20 such that the laser beam 36 is aimed at the pin 29 and passes over the top of the golf ball 27 which it is centrally located in front of the face 26 in position to be putted.

It is important to note that by mounting the laser generating module 35 in the vertical section 32 of the shaft 21, as shown in FIG. 2, the laser beam 36 is centered above and adjacent to the top of the golf ball 27 independent of the magnitude of the angle 34. By affixing the laser module 35 in this location, its laser beam 36 may be aimed at the pin 29 while maintaining the club face 26 perpendicular to the intended path of the ball regardless of the distance of the putt.

If the laser module 35 were located in the non-vertical section 31, as disclosed in prior art, its beam would require a unique horizontal and a unique vertical aiming angle for each putt of varying distance in order to maintain the club face 26 perpendicular to the intended path of the ball while aiming the laser beam at the pin 29. The aforementioned compound angle adjustment requires a more complicated and costly gimbal type mounting arrangement for the mirror than is needed for the laser module having the optimum mounting location and arrangement disclosed in this embodiment.

It is also important to note that by mounting the laser module 35 in the shaft location as noted above, the angle 34 may be adjusted by the user to suit his or her specific height requirements without affecting the aim of the laser system. Such an adjustment may typically be accomplished by holding the vertical section 32 in a vise and setting the angle 34 with a bending force applied at the grip 24.

Figure 3:
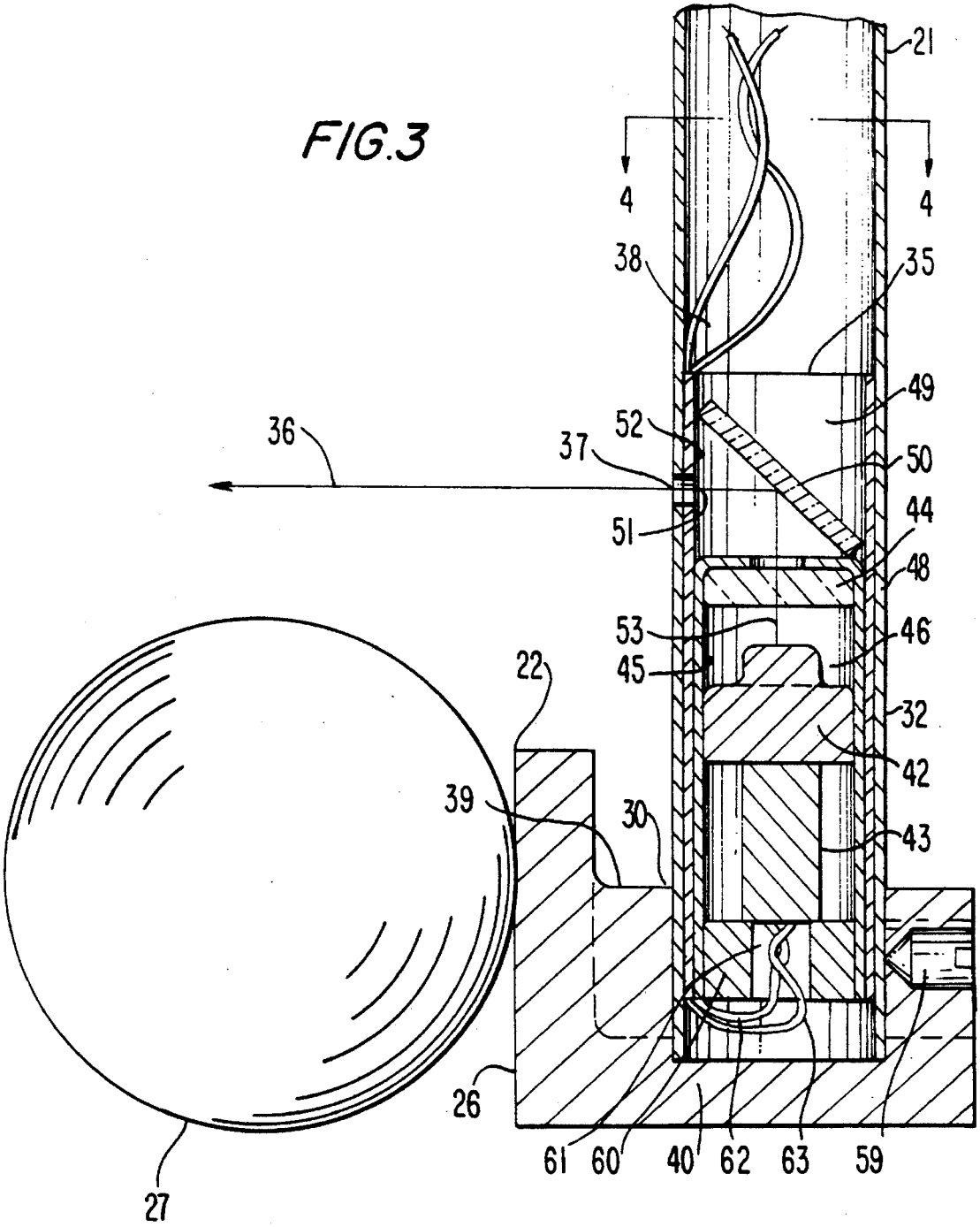
FIG. 3 is a sectional view of the putter head shown in FIG. 2 taken along lines 3—3.

Referring now to FIG. 3, there is shown in the drawing an enlarged sectional view of the putter head 22 illustrated in FIG. 2 taken along lines 3—3. FIG. 3 delineates the configuration and mounting arrangement of the laser beam generating module 35 contained in the hollow core 38 of the vertical section 32. The laser generating module 35 in the embodiment shown comprises standard commercially available components such as a laser diode 42, a diode driver circuit 43 and a laser beam collimating lens 44. These components are well known and may either be obtained as individual devices and assembled into a cylindrical module housing 45, fabricated from a metallic material preferably steel, having an axial core 46, as shown in FIG. 3, or they may be purchased pre-packaged as a laser diode module assembly from any one of a number of vendors specializing in laser module assemblies such as Lyte Optronics, Santa Monica, Calif.

In either case, the cylindrical module assembly housing 45 is affixed, as shown in FIG. 3, in an outer cylindrical housing 48, fabricated from a metallic material preferably steel having an axial core 49 in which is also mounted a reflecting mirror or prism 50. The mirror or prism 50 reflects a laser beam 53 emitted from the laser diode 42 through a lateral opening 51 in a wall 52 of the outer cylindrical housing 48 which is aligned with the lateral bore 37. The outer cylindrical housing 48 slideably fits into the hollow core 38 at a shaft end 40 and provides rigid structural alignment between the laser diode 42 and the mirror or prism 50.

During assembly of the head 22 to the shaft 21, the striking face 26 is optically aligned perpendicular to the laser beam 36 and locked in position by a suitable fastening means such as a set screw 59 which contacts the shaft 21 with a substantial retaining force. The shaft 21 is prevented from collapsing due to this force by a cylindrical metallic plug 60, preferably fabricated from steel, having a central bore 61 through which a first wire 62 and a second wire 63 are routed from the diode driver circuit 43 to a power source which, as will be described in detail below, is located in the shaft 21 at the grip 24 end of the club 20. The wires are thin gage elastic resin insulated copper conductors and are routed through a groove (not shown) formed in the wall 52 of the cylindrical housing 48.

Unlike prior art devices, the laser module 35 of the present invention is positioned such that its laser aiming beam 36 is projected through a lateral bore 37 in the first end of the shaft. The centerline of the lateral bore 37 is coincident with the centerline of the projected laser beam 36 and extends in an essentially horizontal direction perpendicular to the club face 26 in a vertical diametral plane of the golf ball 27 defined by the ball's vertical diameter a–b (FIG. 2). When the club is properly aligned to produce a straight putt, the laser beam 36 of the present invention may be aimed at the pin 29 (FIG. 1) above and in line with the intended path of the ball, regardless of the distance of the putt without the need for horizontal and vertical angle mirror adjustments and without the need for an external mounting bracket to position the laser.

Figure 4:
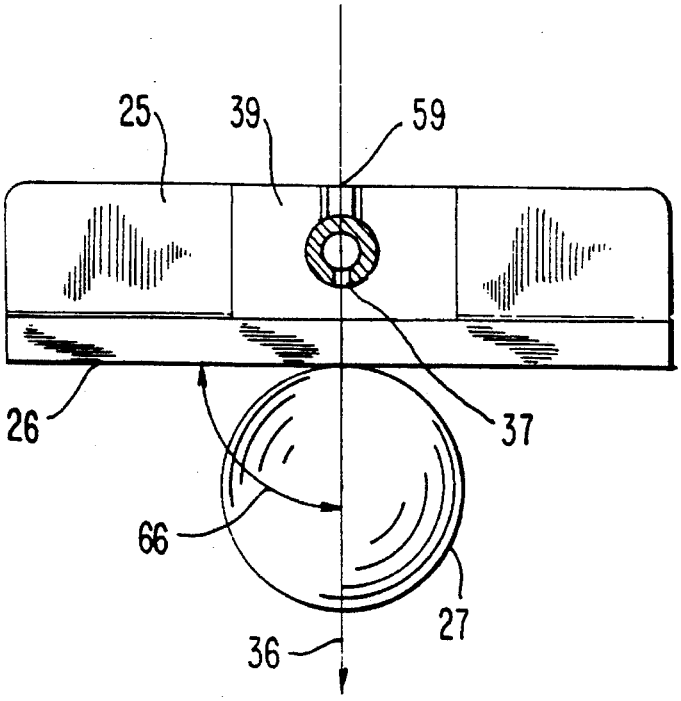
FIG. 4 is a top sectional view of the putter head shown in FIG. 3 taken along lines 4—4.

FIG. 4 is a sectional view of the club head shown in FIG. 3 taken along lines 4—4. As can be seen from the figure, the laser beam 36 is emitted from the lateral bore 37 above the golf ball 27 at an angle 66 which is essentially perpendicular to the striking face 26.

Figure 5:
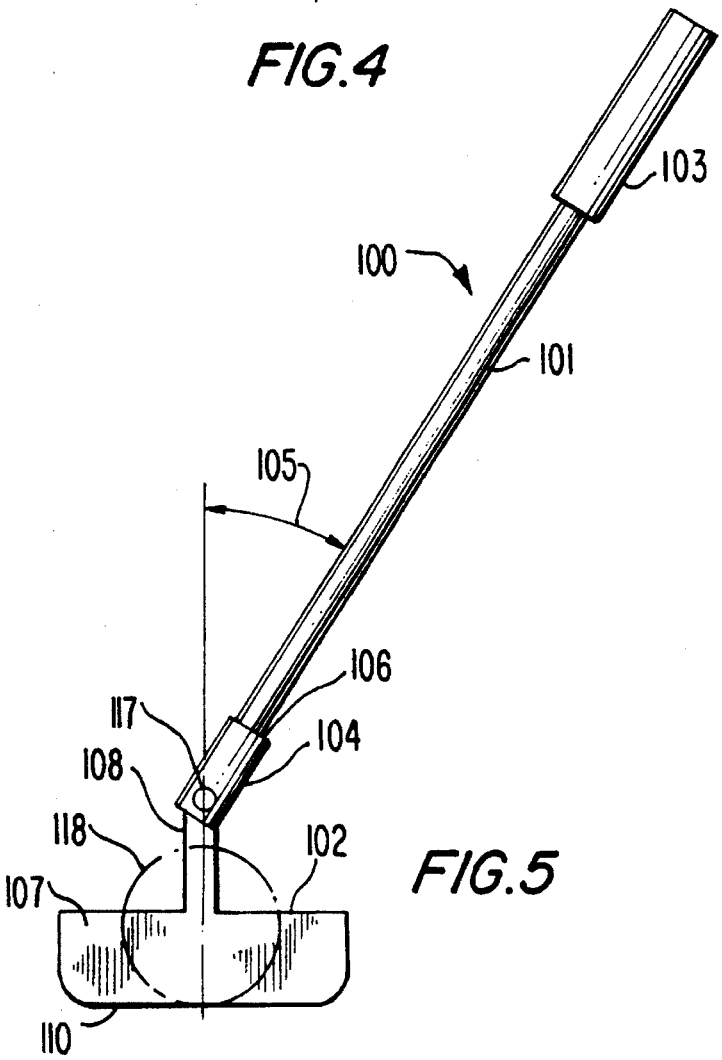
FIG. 5 is a front elevation of an alternate embodiment of the golf club putter and laser aiming system shown in FIG. 1.

Turning now to FIG. 5, in the drawing there is illustrated an alternate embodiment of the invention offering certain variations over the first embodiment. Principally, the club head in the alternate embodiment includes an integral shaft attachment portion which locates the shaft mounting hole in front of and above the club face rather than the shaft mounting hole being located behind the face in the heel of the head as in the first embodiment. In this club head construction, the laser generating module may be positioned laterally in the shaft attachment portion of the head and the laser beam aimed in a horizontal direction over the path of the ball perpendicular to the striking face of the club without need for any external mounting brackets or reflecting mirrors.

Figure 6:
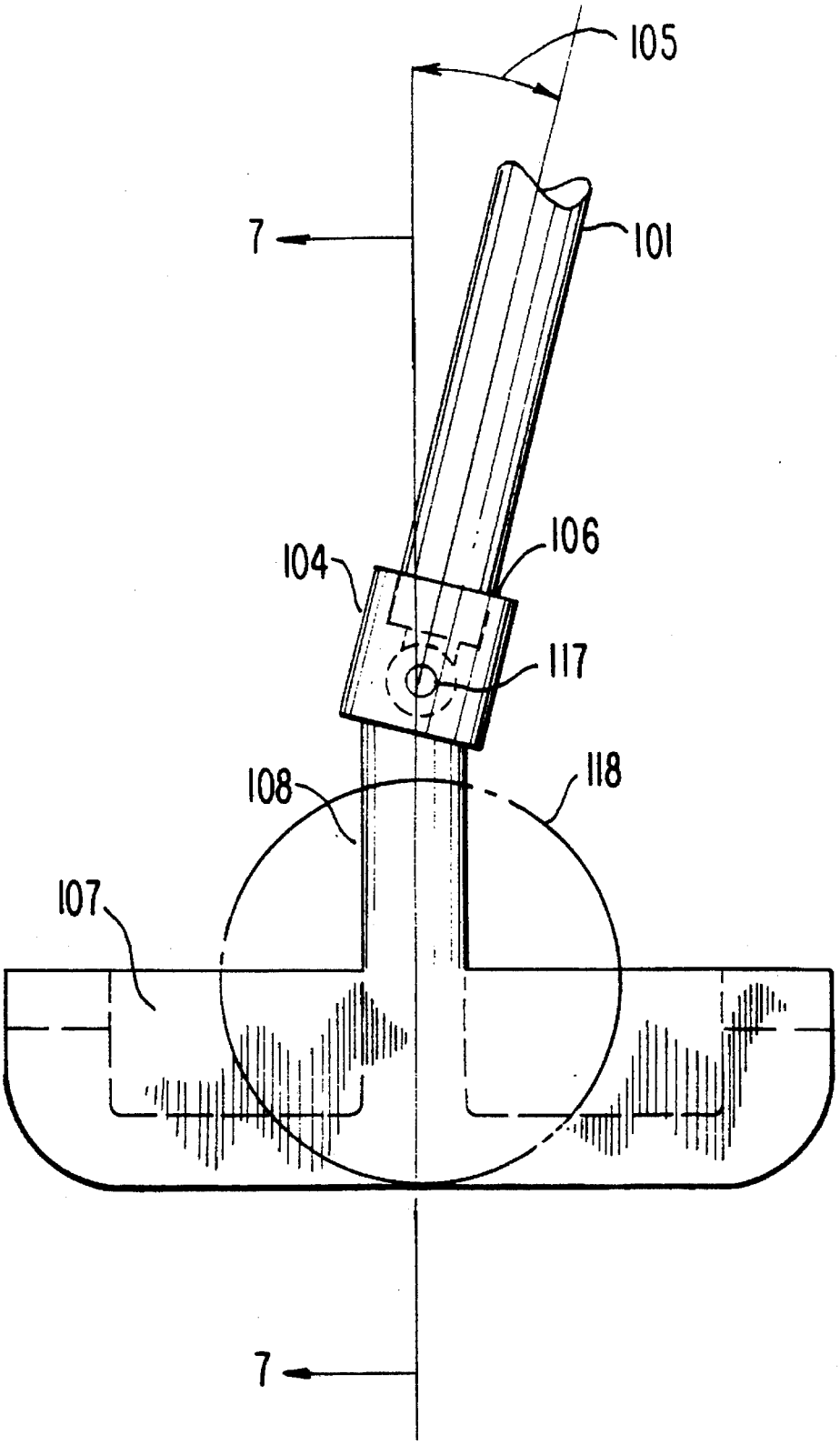
FIG. 6 is an enlarged fragmentary front elevation of the putter head shown in FIG. 5.
Figure 6A:
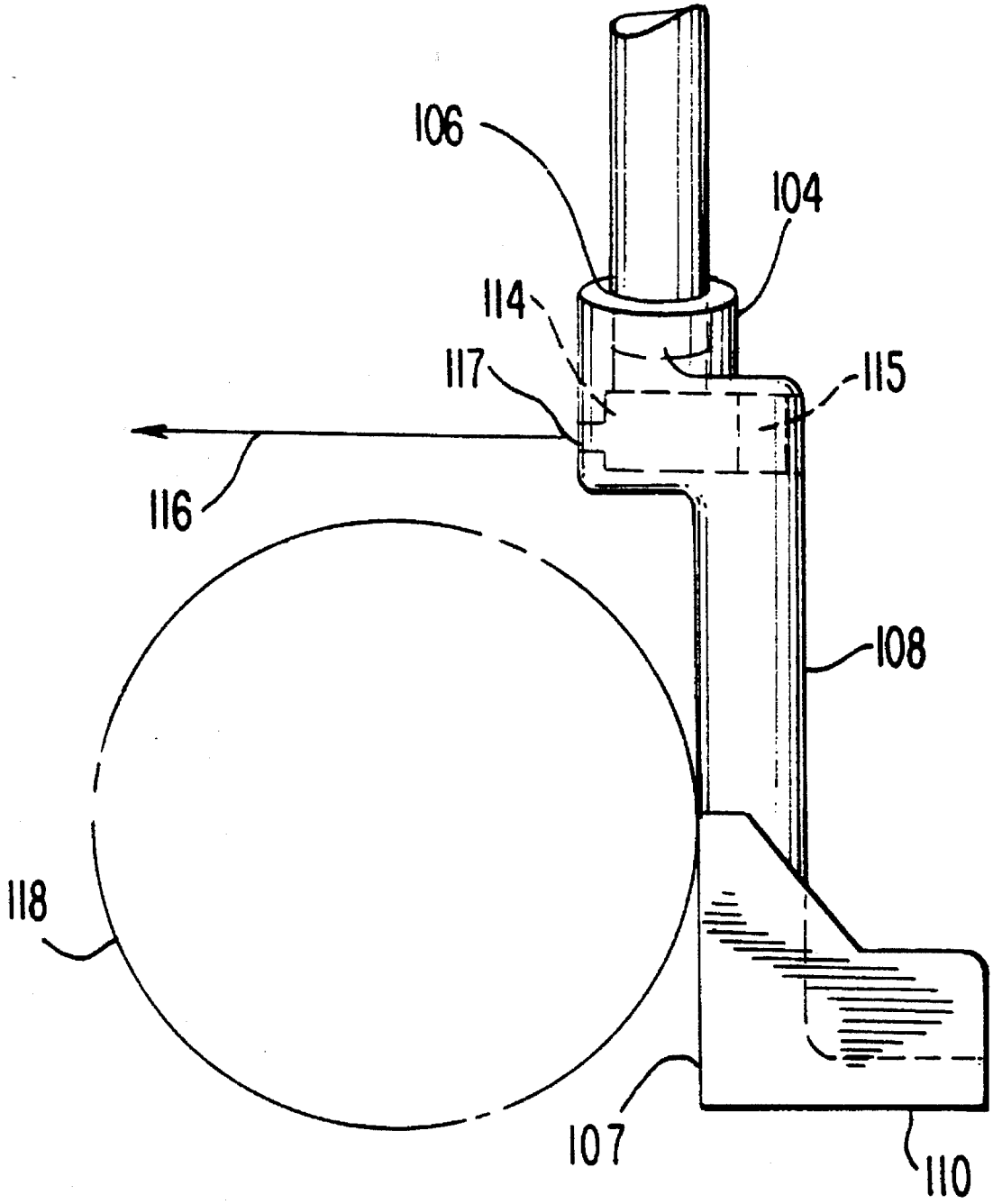
FIG. 6A is an enlarged fragmentary sidle elevation of the putter head shown in FIG. 6.

As illustrated in FIGS. 5, 6 and 6A, a putter, generally referred to by reference number 100 comprises a shaft 101, a head 102 and a grip 103. In this alternate embodiment, the type of head 102 shown is typically a one piece casting fabricated from a metallic material such as brass or steel and includes a generally flat weighted heel portion 110, an essentially vertical ball striking face 107, and an integral shaft attachment portion 108 extending in a substantially vertical direction from the ball striking face 107 to an integral hosel 104. The one piece casting is preferably formed such that the shaft attachment portion 108 locates the hosel 104 in front of and above the face 107. The hosel 104 is disposed from vertical at an angle 105 to receive and affix the shaft 101 in a close fitting shaft mounting hole 106. The vertical dimension of the shaft attachment portion 108, the magnitude of the angle 105 and the length of the shaft 101 determine the position of the player's hands when he or she holds the grip 103.

A laser beam generating module 114 is mounted in an inner cavity 115 formed in the shaft attachment portion 108, and as will be explained in more detail below, is adapted to project a laser aiming beam 116 through a lateral bore 117 in the shaft attachment portion 108. The beam 116 is projected in an essentially horizontal direction above a golf ball 118 (shown in phantom) perpendicular to the striking face 107.

When using the club 100 described in this embodiment to practice putting with the cup 28 and pin 29 arrangement illustrated in FIG. 1, the player aligns the club 100 before stroking a putt such that the laser beam 116 when aimed at the pin 29 passes over the top of the golf ball 118 in a horizontal direction perpendicular to and above the face 107 at a location where the golf ball 118 is positioned to be struck.

By mounting the laser beam generating module 114 in the shaft attachment portion 108, the laser beam 116 is centered above and adjacent to the top of the ball 118 independent of the magnitude of the angle 105. Thus, the angle 105 of the shaft 101 may be adjusted by the user to suit his or her specific height requirements without affecting the aim of the laser system. Such an adjustment is accomplished by holding the hosel 104 in a vise and setting the angle 105 of the shaft 101 by applying a bending force at the handle 103.

Figure 7:
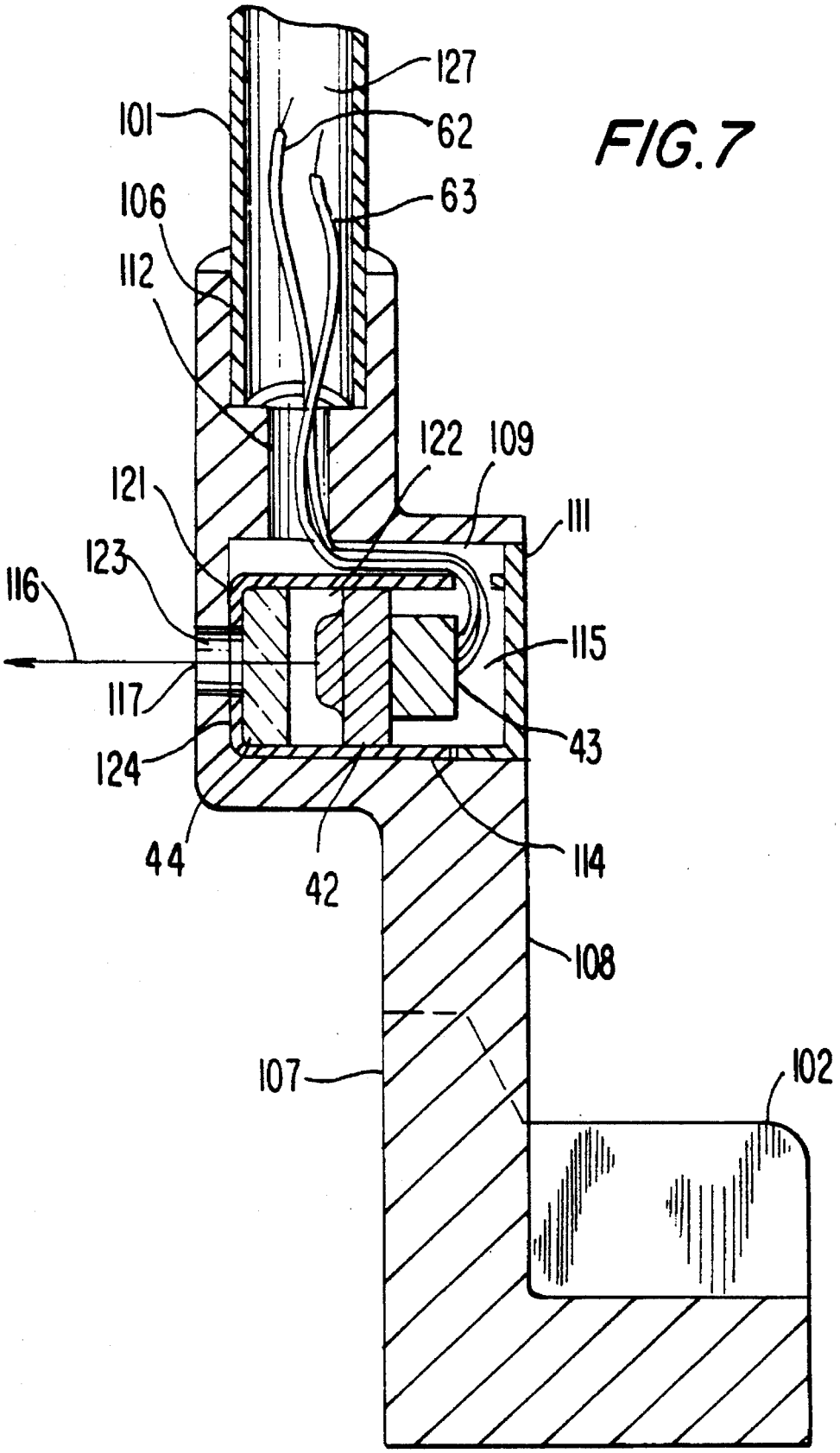
FIG. 7 is a sectional view of the putter head detailed in FIG. 6 taken along lines 7—7.

Referring now to FIG. 7, there is illustrated in the drawing an enlarged sectional view of the putter head 102 shown in FIG. 6 taken along lines 7—7. FIG. 7 delineates the configuration and mounting arrangement of the laser beam generating module 114 contained in the inner cavity 115 of the shaft attachment portion 108. The laser generating module 114 in this embodiment is of the same type as the laser generating module 35 incorporated in the first embodiment. As previously mentioned, this type of laser diode module comprises standard components, the laser diode 42, the diode driver circuit 43 and the beam collimating lens 44. These components are well known and are either obtained as separate pieces and assembled into a cylindrical module housing 121, fabricated from a metallic material such as steel, having an axial core 122 as shown in FIG. 7, or are purchased pre-packaged as previously noted. The cylindrical module housing 121 is affixed laterally, as shown in FIG. 7, in the inner cavity 115 located in the shaft attachment portion 108. The laser diode 42 projects the laser beam 116 through a lateral opening 123 in a front wall 124 of the cylindrical module housing 121 which is aligned with the lateral bore 117 in the shaft attachment portion 108. The cylindrical module housing 121 slideably fits into the inner cavity 115 and provides rigid structural alignment between the laser diode 42 and the collimating lens 42. A cap 111, is press fit into the rear opening of the inner cavity 115 to hold the cylindrical housing 121 in position.

Unlike prior art devices, this embodiment discloses a laser aiming system that incorporates a mounting arrangement which completely conceals the laser generating module 114 in the head 102 of the club 100. In addition, and without the need for external mounting brackets, costly fiber optic cables and/or mirrors, this novel mounting arrangement permits the laser aiming beam 116 to be emitted in an essentially horizontal direction above the golf ball 118 perpendicular to the face 107 at a location above the face 107 where the golf ball 118 is positioned to be struck.

In this embodiment, the inner cavity 115 is formed during the casting process in the head 102 with sufficient dimensional precision relative to the face 107 such that the laser module 114, when installed in the cavity 115, emits a laser aiming beam which is essentially aligned perpendicular to the face 107 without need for further optical alignment.

Additionally, three communicating cavities, a first wire cavity 109, a second wire cavity 112 and an opening or shaft mounting hole 106 are formed in the top portion of the inner cavity during the casting process. As shown in FIG. 7, the first wire 62 and the second wire 63 are routed from the diode driver circuit 43 through the aforementioned cavities and through an internal axial bore 127 of the shaft 101 to the power source for the laser circuit which, as will be described in detail below, is located in the grip end of the shaft.

Figure 8:
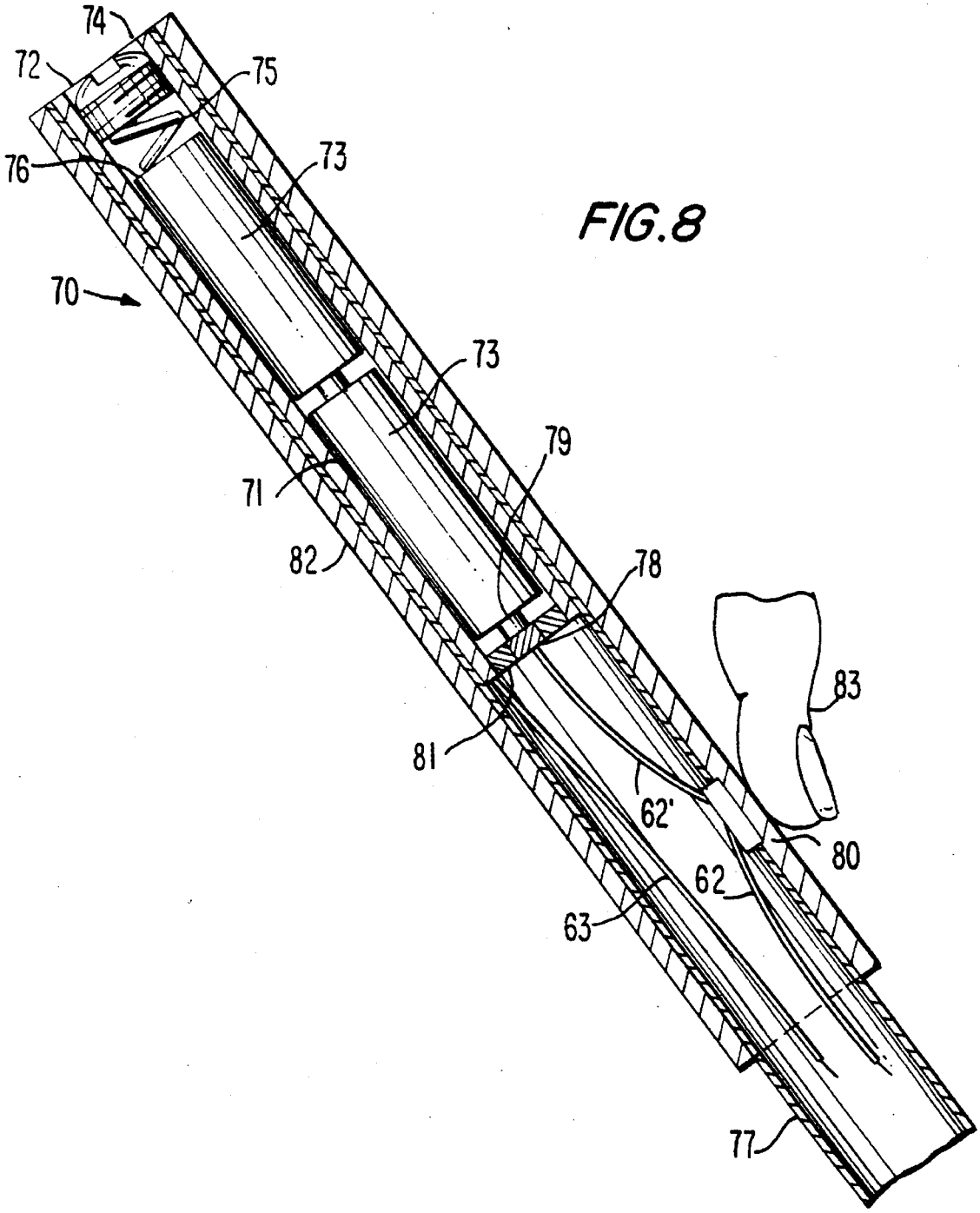
FIG. 8 is a detail of a battery and s witch pack mounted in the grip end of the club.

FIG. 8 illustrates a power pack, generally referred to by reference number 70, located in the non-vertical grip end 77 of the angularly adjustable shaft of the present invention. The power pack supplies an electrical current through the first wire 62 and the second wire 63 to the laser diode driver circuit and is comprised of: 1) a metallic battery housing 71 which closely fits into an axial core 72 at the grip end 77 of the shaft; 2) at least one battery 73; 3) a threaded cap 74 which secures the battery 73 in position and makes electrical contact via a spring 75 between the battery casing electrode 76 and the metallic housing 71; and 4) a metallic disc 78 which is electrically isolated from the metallic housing 71 by a doughnut shaped insulator 81 but which makes electrical contact to a center electrode 79 of the battery 73. The metallic disc 78 is electrically connected to a button switch 80 by a lead wire 62'. The metallic housing 71 is electrically connected to the second wire 63.

As shown in FIG. 8, the button switch 80, a device with normally open contacts, is located beneath a resilient grip covering 82 at the grip end 77 of the shaft and is activated by pressure from the player's thumb applied through the grip covering 82. Because the shaft angle of the present invention is adjustable, the grip end 77 can be inclined ergonomically to suit each user such that he or she may properly grasp the club while applying thumb pressure to activate the laser.

When the button switch 80 is depressed, an electrical circuit is completed through the switch 80 whereby the electrical current is transmitted to the diode driver circuit 43 through the first wire 62 and the second wire 63. The laser diode driver 43 may, as an alternate configuration to the two embodiments defined above, be located in the grip end of the club instead of in the head end.

It will thus be seen that the laser aiming system embodiments described herein permit laser generating modules to be mounted and concealed within putters and yet permit the laser aiming beam to be emitted from the putter perpendicular to and above the face of the putter and above the location on the face where the golf ball is ideally positioned to be struck.

It is also to be understood that the present invention is not limited to the precise details of structure shown and set forth in this specification for obvious modifications will occur to those skilled in the art to which the invention pertains.

What is claimed is:

1. A golf club putter with laser aiming comprising:

a shaft including a hollow axial length portion having a putter head affixed at a first end of said shaft and a grip affixed at a second end of said shaft;

said putter head having a face on a front side thereof for striking a golf ball and having an opening on a top side of said putter head securing said first end of said shaft;

said first end of said shaft having a lateral bore therethrough and a laser module mounted in said first end of said shaft including means for projecting a laser beam coincident with the axis of said bore;

said first end of said shaft being secured to said top side of said head with an angular disposition such that said axis of said lateral bore extends in a substantially horizontal direction above said golf ball in a vertical diametral plane of said golf ball perpendicular to said face when said golf ball is positioned to be struck; and said laser beam being employed by a user of said club for controlling the direction of said golf ball.

2. A golf club putter with laser aiming in accordance with claim 1 wherein said first end of said shaft is a substantially vertical section to which said head is attached.

3. A golf club putter with laser aiming in accordance with claim 1 wherein said second end of said shaft is a non-vertical section to which said grip is affixed on an end thereof.

4. A golf club putter with laser aiming in accordance with claim 1 wherein said laser module is mounted axially in said first end of said shaft.

5. A golf club putter with laser aiming in accordance with claim 3 wherein said non-vertical section of said shaft is disposed at a bend angle which may be adjusted to suit the height requirements of a user.

6. A golf club putter with laser aiming in accordance with claim 3 wherein a thumb activated switch is contained in said grip for controlling an electrical current to said laser module.

7. A golf club putter with laser aiming comprising:

a shaft having a hollow length portion;

a head secured at a first end of said shaft having a face on a front side thereof for striking a golf ball;

said head including a shaft attachment means including a laterally extending bore and an opening in a top portion of said head, communicating with said bore, and securing said head to said first end of said shaft;

a grip for holding said golf club secured at a second end of said shaft;

a laser module positioned in said bore adapted to emit a laser beam through said lateral bore;

said laser beam being emitted perpendicular to and above said face and above an approximate location on said face where said golf ball is positioned to be putted so that said beam is emitted above said golf ball to be putted; and said laser beam being employed by a user of said club for controlling the direction of said golf ball.

8. A golf club putter with laser aiming in accordance with claim 7 wherein said shaft attachment means extends in a substantially vertical direction and connects said head to said first end of said shaft.

9. A golf club putter with laser aiming in accordance with claim 7 wherein said second end of said shaft is a non-vertical section to which said grip is affixed on an end thereof.

10. A golf club putter with laser aiming in accordance with claim 9 wherein said non-vertical section is disposed from vertical at an angle which may be adjusted to suit a player's height requirement.

11. A golf club putter with laser aiming in accordance with claim 9 wherein a thumb activated switch is contained in said grip for controlling an electrical current to said laser module.

* * * * *